United States Patent [19]

Norigoe

[11] Patent Number: 4,626,115

[45] Date of Patent: Dec. 2, 1986

[54] DOT PRINTER HEAD

[75] Inventor: Takashi Norigoe, Shizuoka, Japan

[73] Assignee: Tokyo Electric Co., Ltd., Tokyo, Japan

[21] Appl. No.: 709,716

[22] Filed: Mar. 8, 1985

[30] Foreign Application Priority Data

Mar. 8, 1984 [JP] Japan ..... 59-44489

[51] Int. Cl.[4] ..... B41J 1/60; B41J 1/56

[52] U.S. Cl. ..... 400/124; 400/174; 400/121; 101/93.04

[58] Field of Search ..... 400/121, 124, 174, 118, 400/175; 101/93.05, 93.04

[56] References Cited

U.S. PATENT DOCUMENTS

| | | | |
|---|---|---|---|
| 4,140,406 | 2/1979 | Wolf et al. | 400/124 |
| 4,230,038 | 10/1980 | Hebert | 400/124 X |
| 4,242,004 | 12/1980 | Adler | 400/124 |
| 4,279,521 | 7/1981 | Kightlinger | 400/124 |
| 4,320,981 | 3/1982 | Harrison et al. | 400/124 |
| 4,444,519 | 4/1984 | Howell et al. | 400/124 X |

FOREIGN PATENT DOCUMENTS

| | | | |
|---|---|---|---|
| 2553762 | 6/1977 | Fed. Rep. of Germany | 400/124 |
| 163580 | 10/1982 | Japan | 400/124 |

OTHER PUBLICATIONS

IBM Tech. Disc. Bulletin, "Articulated Print Wire Actuator", Lisinski, vol. 21, No. 1, Jun. 1978, pp. 18–19.

*Primary Examiner*—Edgar S. Burr
*Assistant Examiner*—James R. McDaniel
*Attorney, Agent, or Firm*—Oblon, Fisher, Spivak, McClelland & Maier

[57] ABSTRACT

A dot printer head including a plurality of cores each surrounded by a coil, a yoke connected to the cores magnetically, and a plurality of armatures each facing one of the cores and the yoke and having one end to which a needle is connected. A plurality of projections are provided on the yoke, and each armature has an opening in which one of those projections is engaged. This arrangement enables each armature and the yoke to face each other in a large area, while the area in which they face each other and which extends in parallel to the armature can be small. The pivot about which each armature is rotatable can be brought closer to the corresponding core. This enables a reduction in the air gap between the armature and the core and thereby the production of a large attracting force from a small magnetomotive force. It also enables a reduction in the equivalent mass of each armature and thereby an increase in the speed of printing and a reduction in the power consumption of the printing apparatus.

12 Claims, 7 Drawing Figures

DOT PRINTER HEAD

BACKGROUND OF THE INVENTION

1. Field of the Invention

This invention relates to a dot printer having a needle which is driven to print combinations of dots each defining a particular letter or figure. More particularly, it relates to the head of any such dot printer.

2. Description of the Prior Art

There is known a dot printer in which armatures are actuated upon energization of coils to strike needles against a platen for printing dots. The armatures are driven by a mechanism which is shown by way of example in FIGS. 1 and 2. Each of the coils 3 is disposed about one of a plurality of cores 2 each forming an integral part of a yoke 1. Each of the armatures 5 is supported rotatably about a pivot 6 to cause the needle 4 to strike against the platen when the coil 3 is energized. Each armature 5 has a pair of recesses 8. A guide 7 is provided between every two adjoining armatures 5 and has one end disposed in one of the recesses 8 of one armature, while the other end of the guide 7 is disposed in one of the recesses 8 of the other armature. The guides 7 are located in a plane facing the yokes 1. If the coils 3 are energized, the armatures 5 are attracted toward the cores 2 to drive the needles 4. A magnetic flux travels from the cores 2 to the yokes 1 through the armatures 5 and from the yokes 1 to the cores 2. In order to perform effective printing, it is necessary to increase the attracting force of the cores 2 by applying a small magnetomotive force. This necessitates an increase in the surface area S of the region in which each armature 5 faces the corresponding yoke 1. This in turn requires an increase in the radial width $l_3$ of the yoke 1. The distance between the pivot 6 and the center of the core 2 is shown at $l_1$, and the distance between the pivot 6 and the free end of the armature 5 at which it hits the needle 4 is shown at $l_2$. If the distance $l_3$ is increased, it is necessary to increase the distance $l_1$ resulting in the necessity for an increased air gap G to maintain an appropriate stroke $A_s$ for the movement of the free end of the armature 5. An increase in the air gap G, however, results in the failure of the core 2 to produce a satisfactorily large attracting force. Moreover, an increase in the distance $l_1$ means a lower lever ratio $l_2/l_1$ and an increase in the equivalent mass of the armature 5. This disables fast printing and gives rise to an increase in power consumption. These problems are worsened by the presence of the recesses 8 in the plane facing the yoke 1. If the recesses 8 are taken into account, an increase in the surface area S calls for a greater increase in the distances $l_3$ and $l_1$ and gives rise to a greater increase in the air gap G.

SUMMARY OF THE INVENTION

It is an object of this invention to increase the force for attracting the armatures of a dot printer.

It is another object of this invention to reduce the equivalent mass of the armatures.

It is still another object of this invention to achieve fast printing.

It is a further object of this invention to reduce the power consumption of a dot printer.

It is a still further object of this invention to provide a simple structure for supporting the armatures of a dot printer.

Other objects of this invention will become apparent from the following description.

DETAILED DESCRIPTION OF THE INVENTION

Figure 1:
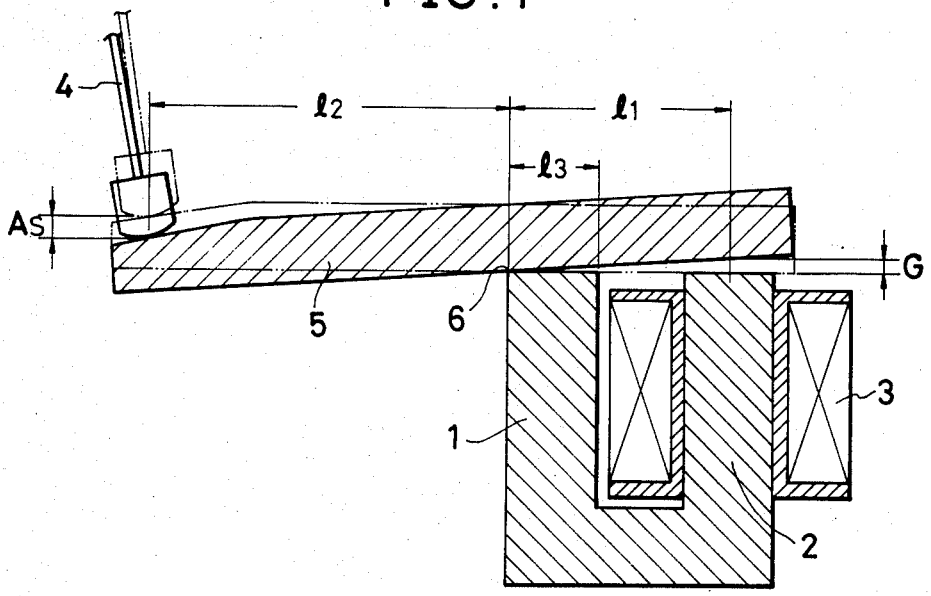
FIG. 1 is a fragmentary side elevational view, partly in section, of a known armature, yoke and core arrangement in a dot printer.
Figure 2:
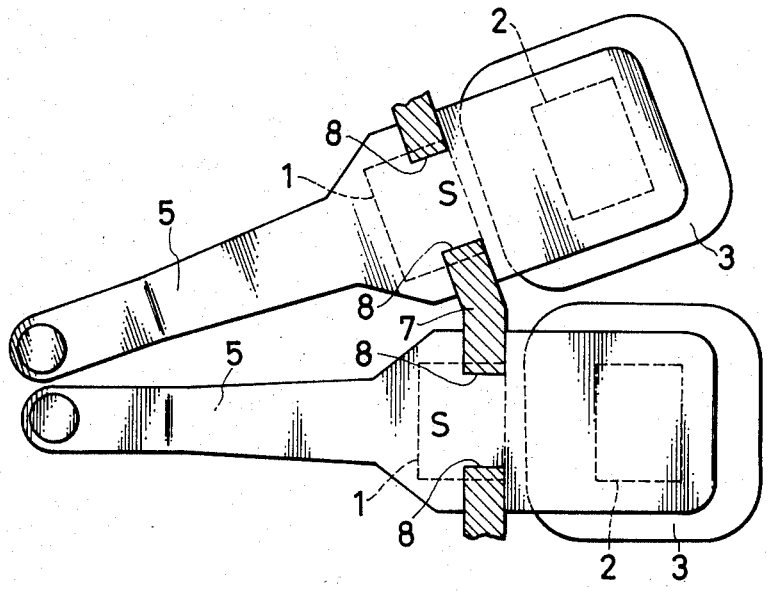
FIG. 2 is a fragmentary front elevational view of the device shown in FIG. 1.
Figure 3:
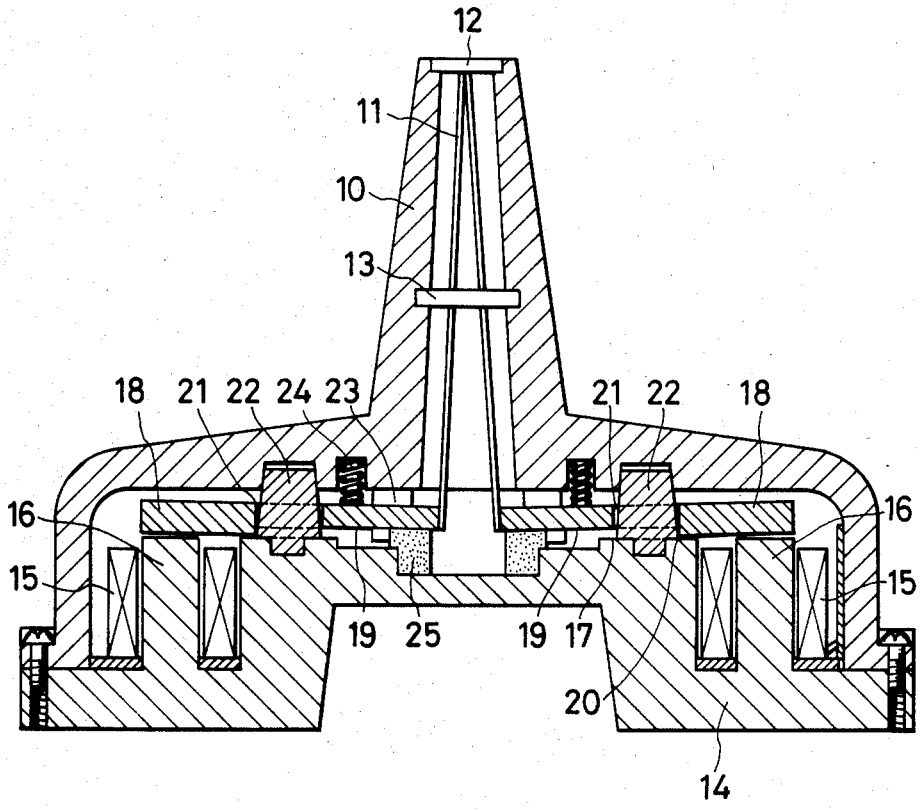
FIG. 3 is a horizontal sectional view of an apparatus embodying this invention.
Figure 4:
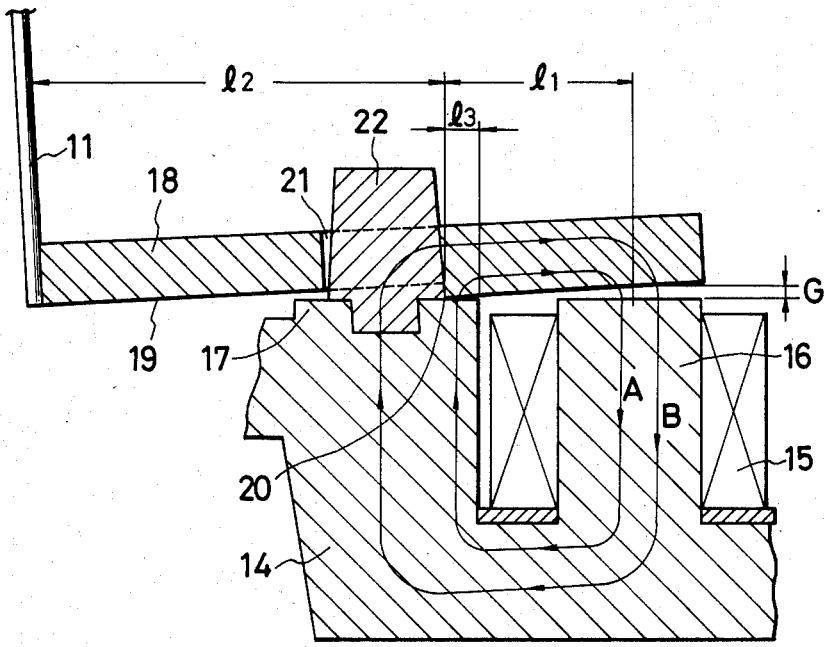
FIG. 4 is a fragmentary enlarged side elevational view, partly in section, of the armature, yoke and core arrangement shown in FIG. 3.
Figure 5:
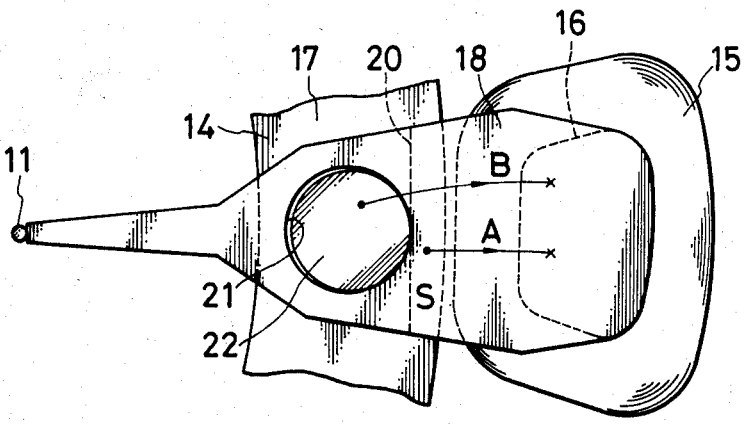
FIG. 5 is a fragmentary enlarged front elevational view of the apparatus shown in FIG. 3.

An apparatus embodying this invention is shown in FIGS. 3 to 5. A pair of needle guides 12 and 13 are secured to a guide frame 10 for supporting a plurality of needles 11 slidably. A plurality of cores 16 are disposed in an annular array on a circular yoke 14 screwed to the guide frame 10. Each core 16 forms an integral part of the yoke 14. A coil 15 surrounds each core 16. The yoke 14 has an annular projection 17. A plurality of armatures 18 face the cores 16 and the projection 17. Each armature 18 has a free end to which one of the needles 11 is secured. Each armature 18 is formed intermediate the ends thereof with a shoulder 19 defining a portion of reduced thickness which extends toward the needle 11. The shoulder 19 has a corner which contacts the yoke projection 17 and thereby defines a pivot 20 about which the armature 18 is rotatable. The projection 17 and each armature 18 have therebetween a small surface S of contact which defines a magnetic path. Accordingly, the outer peripheral edge of the projection 17 and the pivot 20 have a small distance $l_3$ therebetween, and the center of the core 16 and the pivot 20 have, therefore, a small distance $l_1$ therebetween.

Each armature 18 has a circular opening 21 to which the pivot 20 is tangential. A pole 22 formed from a magnetic material is welded or otherwise secured to the yoke projection 17 and extends through the opening 21. The pole 22 has a circular cross section and is tapered. The pole 22 can, of course, be formed as an integral part of the yoke 14. A plurality of armature guide members 23 are formed on the guide frame 10 for restricting the direction in which each armature 18 is rotated. An armature spring 24 is provided for urging each armature 18 into its original position in which its free end rests on a stop member 25.

If a particular coil 15 is energized, a magnetic flux travels along a magnetic path A defined by the core 16, yoke 14 and armature 18, and a magnetic path B defined by the core 16, yoke 14, pole 22 and armature 18. The core 16 attracts the armature 18 and thereby enables the needle 11 to strike against the platen to effect the printing of a dot. As the yoke 14 and the pole 22 have a large area of contact therebetween, and as the armature 18 and the pole 22 have a large area in which the outer surface of the pole 22 faces the armature surface defined by the opening 21, the yoke 14 and the armature 18 have only a small amount of magnetic resistance therebetween, though the area S in which the armature 18 faces the yoke projection 17 may be small. This enables a reduction in the distances $l_3$ and $l_1$ and thereby in the air gap G between the core 16 and the armature 18, as shown in FIG. 4. This ensures a reduction in the magnetic resistance between the core 16 and the armature 18 and enables the core 16 to exert a strong attracting force on the armature 18. A reduction in the distance $l_1$ gives rise to a higher $l_2/l_1$ ratio in which $l_2$ stands for the distance between the needle 11 and the pivot 20, and thereby a reduction in the equivalent mass of the armature 18. The apparatus is, therefore, suitable for fast printing and achieves a reduction in power consumption.

Figure 6:
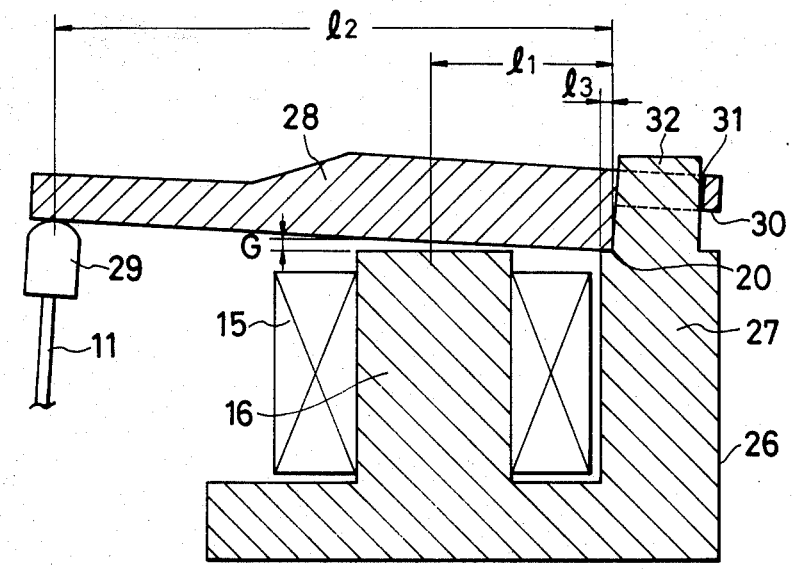
FIG. 6 is a fragmentary horizontal sectional view of another armature, yoke and core arrangement embodying this invention.
Figure 7:
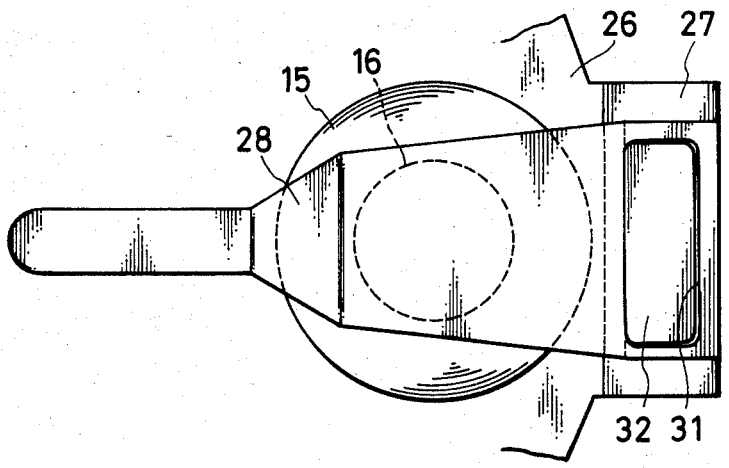
FIG. 7 is a fragmentary front elevational view of the arrangement shown in FIG. 6.

Another embodiment of this invention is shown in FIGS. 6 and 7. In this embodiment the cores disposed radially inwardly of the pivots, while the cores 16 are disposed radially outwardly of the pivots in the apparatus of FIGS. 3 to 5. A yoke 26 includes a plurality of cores 16 disposed in an annular array. Each core 16 is associated with a coil 15, and a plurality of equally spaced apart supporting walls 27 are each located radially outwardly of one of the cores 16. Each armature 28 faces one of the cores 16 and one of the walls 27. Moreover, each armature 28 has an inner end on which the rear end 29 of a needle 11 abuts. Each needle 11 is urged toward its original position by an armature spring (not shown). The armature 18 has at its outer end a shoulder 30 which spaces it apart from the supporting wall 27. The wall 27, and the shoulder 30 have a corner of contact which defines a pivot 20 about which the armature 28 is rotatable. The shoulder 30 has a rectangular opening 31 having a side located in the plane in which the pivot 20 lies. A projection 32 formed from a magnetic material extends through the opening 31 and forms an integral part of the yoke 26. The projection 32 reduces the magnetic resistance between the supporting wall 27 and the armature 28. This enables a reduction in the distance $l_3$ between the pivot 20 and the inner edge of the wall 27, the area S in which the armature 28 faces the wall 27 and thereby the distance $l_1$ between the center of the core 16 and the pivot 20 as compared with the distance $l_2$ between the needle 11 and the pivot 20. Therefore, the air gap G is sufficiently small to reduce the equivalent mass of the armature 28.

What is claimed is:

1. A dot printer head comprising:

(a) a yoke having a central axis;

(b) a plurality of cores disposed on said yoke around said central axis and magnetically connected to said yoke, each one of said plurality of cores extending from said yoke in a first direction;

(c) a plurality of coils, each one of said plurality of coils surrounding an associated one of said plurality of cores;

(d) a plurality of projections disposed on said yoke around said central axis and magnetically connected to said yoke, each one of said plurality of projections extending from said yoke in said first direction and each one of said plurality of projections being located on the same radial line relative to said central axis as an associated one of said pluraity of cores;

(e) a plurality of armatures, each one of said plurality of armatures:

(i) being mounted on one of said plurality of projections extending from said yoke for pivotable movement about a pivot on said yoke between the associated one of said cores and the associated one of said projections;

(ii) facing an associated one of said cores; and (iii) having a hole therethrough to receive one of said plurality of projections, said hole being larger than said projections by an amount sufficient to permit said armature to pivot between a rest position and an actuated position thereby providing a magnetic path through each one of said plurality of cores, said yoke, the associated one of said plurality of projections, the associated one of said plurality of armatures, and back to said each one of said plurality of cores; and (f) a plurality of needles, each one of said plurality of needles being operatively connected to one end of an associated one of said plurality of armatures for movement therewith to and from a printing position as said armature moves between said actuated and rest positions.

2. A dot printer head as set forth in claim 1, wherein each of said cores is positioned adjacent to the end of one of said armatures remote from said one end, and said yoke extends between said cores and said one end of each of said armatures.

3. A dot printer head as set forth in claim 1, wherein each of said armatures has toward said one end thereof a portion of reduced thickness defining a shoulder contacting said yoke in the area in which each of said pivots is defined.

4. A dot printer head as set forth in claim 1, wherein each of said openings is circular.

5. A dot printer head as set forth in claim 1, wherein each of said projections is a pole forming an integral part of said yoke.

6. A dot printer head as set forth in claim 1, wherein each of said projections is a pole formed separately from said yoke and welded thereto.

7. A dot printer head as set forth in claim 4, wherein each of said projections has a tapered cross sectional configuration.

8. A dot printer head as set forth in claim 1, wherein said yoke is located adjacent to the end of each of said armatures remote from said one end thereof, and said cores are located between said one end and said yoke.

9. A dot printer head as set forth in claim 8, wherein said remote end of each of said armatures has a portion of reduced thickness defining a shoulder in the area in which its pivot is defined.

10. A dot printer head as set forth in claim 8, wherein each of said openings is rectangular.

11. A dot printer head as set forth in claim 8, wherein each of said projections is a pole forming an integral part of said yoke.

12. A dot printer head as set forth in claim 8, wherein each of said projections is a pole formed separately from said yoke and welded thereto.

* * * * *